US006352033B1

(12) United States Patent
Brede et al.

(10) Patent No.: US 6,352,033 B1
(45) Date of Patent: Mar. 5, 2002

(54) RIMFIRE CARTRIDGE AND PRODUCTION PROCESS THEREFOR

(75) Inventors: Uwe Brede, Furth; Jochen Candidus, Zirndorf; Heinz Riess, Furth, all of (DE)

(73) Assignee: Dynamit Nobel GmbH Explosivstoff-und Systemtechnik, Troisdorf (DE)

( * ) Notice: Subject to any disclaimer, the term of this patent is extended or adjusted under 35 U.S.C. 154(b) by 0 days.

(21) Appl. No.: 09/554,067

(22) PCT Filed: Nov. 6, 1998

(86) PCT No.: PCT/EP98/07084

§ 371 Date: Jul. 11, 2000

§ 102(e) Date: Jul. 11, 2000

(87) PCT Pub. No.: WO99/24779

PCT Pub. Date: May 20, 1999

(30) Foreign Application Priority Data

Nov. 11, 1997 (DE) ..... 197 49 737

(51) Int. Cl.[7] ..... F42B 5/26

(52) U.S. Cl. ..... 102/430; 102/471; 29/1.31; 86/32

(58) Field of Search ..... 102/430, 446, 102/464, 470, 471; 29/1.3, 1.31; 86/10, 23, 32, 33, 36, 37, 38

(56) References Cited

U.S. PATENT DOCUMENTS

| | | | | |
|---|---|---|---|---|
| 2,003,438 A | * | 6/1935 | Guignet | |
| 2,522,208 A | * | 9/1950 | Catlin | |
| 3,257,892 A | * | 6/1966 | Hubbard | 102/471 |
| 3,452,578 A | * | 7/1969 | Kirchner et al. | |
| 5,490,463 A | * | 2/1996 | Lamberty et al. | 102/430 |

FOREIGN PATENT DOCUMENTS

| | | | | |
|---|---|---|---|---|
| EP | 500462 | * | 8/1992 | 102/470 |

* cited by examiner

*Primary Examiner*—Harold J. Tudor
(74) *Attorney, Agent, or Firm*—Antonelli, Terry, Stout & Kraus, LLP

(57) ABSTRACT

The invention relates to a boundary light cartridge and a method for producing the same having a cartridge case (2) with a fitted projectile, a propelling charge powder arranged inside the cartridge case (2), and an ignition assembly for the propelling charge power, whereby the cartridge case (2) has a circumferential radial indentation (10) on the base (3) thereof in which the ignition assembly is arranged. In ignition assemblies which lack harmful substances, the invention provides that the base (3) of the cartridge case is pressed inward at least in partial areas in order to guarantee a complete and uniform reaction during short ignition times of an ignition assembly. As a result, the opening (13) of the indentation (10) is reduced in size toward the interior of the cartridge case (2).

9 Claims, 3 Drawing Sheets a)

b)

a)

b)

RIMFIRE CARTRIDGE AND PRODUCTION PROCESS THEREFOR

BACKGROUND OF THE INVENTION

The invention relates to a rim-fire cartridge and to a process for producing a rim-free cartridge.

A rim-fire cartridge according to the prior art is shown in FIG. 1. A cartridge case 2 has on its base 3 a radial bulge 10, into which is placed an ignition charge 1. The cartridge case 2 is filled with propellent-charge powder 11 and the propellent-charge container 2 is closed with a projectile 12. Known ignition charges 1 contain heavy metals and are very sensitive to impact and friction, which means that even in the case of a low striking-pin energy, the known rim-fire cartridges ensure a uniform and complete reaction of the ignition charge in a comparatively short ignition time $t \leqq 1$ ms.

In comparison with the known pollutant-containing ignition charges, modern environment-friendly ignition charges are less sensitive to friction and impact and in connection with the known rim-fire cartridges can, when fired, result in very long ignition times or even ignition failure.

SUMMARY OF THE INVENTION

The underlying objection of the invention is to improve a rim-fire cartridge and a process for producing a rim-fire cartridge in such a way that even with low-pollutant ignition charges and low striking-pin energy, a complete and uniform reaction of the ignition charge in short ignition times is ensured, so that ignition failures do not occur.

This object is met with respect to the rim-fire cartridge in accordance with the invention as a result of the fact that the base of the cartridge case is pressed inwards at least in partial regions, and as a result of this, the opening of the bulge towards the inside of the cartridge case is reduced.

As a result of this and in contrast with the prior art, the ignition charge is dammed, as a result of which the reaction of the ignition charge at the start of the reaction phase is optimised. As a result of this measure, a uniform and complete reaction of the ignition charge in short ignition times is achieved, so that ignition failures do not occur.

In a preferred embodiment, the base is pressed inwards in the axial direction to the extent of the inside diameter of the cartridge case. As a result of this, the striking-pin energy is used exclusively to deform the bulge, or in other words to deform the charge slot in which the ignition charge is located, and does not have to undergo any losses for the base deformation in the centre of the base of the cartridge case. As a result of this, the ignition sensitivity is substantially improved.

In a further advantageous improvement, the bulge is re-pressed after the ignition charge has been put in, and as a consequence, the ignition charge is compressed. As a result of this, the reaction of the ignition charge is improved. In certain cases, depending on the choice of ignition charge, this compression or re-pressing of the bulge can even be dispensed with.

In one embodiment, the compression or re-pressing of the bulge takes place with a tool having flat pressing faces, for example a combination pliers. As a result of this, the bulge has a more rectangular cross-section.

An alternative advantageous embodiment is distinguished as a result of the fact that the bulge is re-pressed with a sharp-edged tool, with only the region of the bulge that adjoins the cartridge case being re-pressed. As a result of this, the bulge has a more droplet-shaped cross-section.

Alternatively, the object with respect to the process for producing a rim-fire cartridge is achieved as a result of the fact that before the ignition charge is introduced, the base of the cartridge case is pressed inwards at least in partial areas, and as a result of this, the opening of the bulge towards the inside of the cartridge case is reduced.

Advantageously, the base of the cartridge case is pressed inwards in the axial direction to the extent of the inside diameter of the cartridge case. The advantages of these process claims are identical to those of the device claims.

Advantageously, after the ignition charge has been introduced, the bulge is re-pressed for the purpose of compression. In one embodiment, this takes place with a tool having flat pressing faces, and in another embodiment with a sharp-edged tool, in which case only the region of the bulge that adjoins the cartridge case is pressed in.

BRIEF DESCRIPTION OF THE DRAWINGS

Further features of the invention emerge from the figures which are described in the following, in which.

DETAILED DESCRIPTION OF THE PREFERRED EMBODIMENTS

Figure 1:
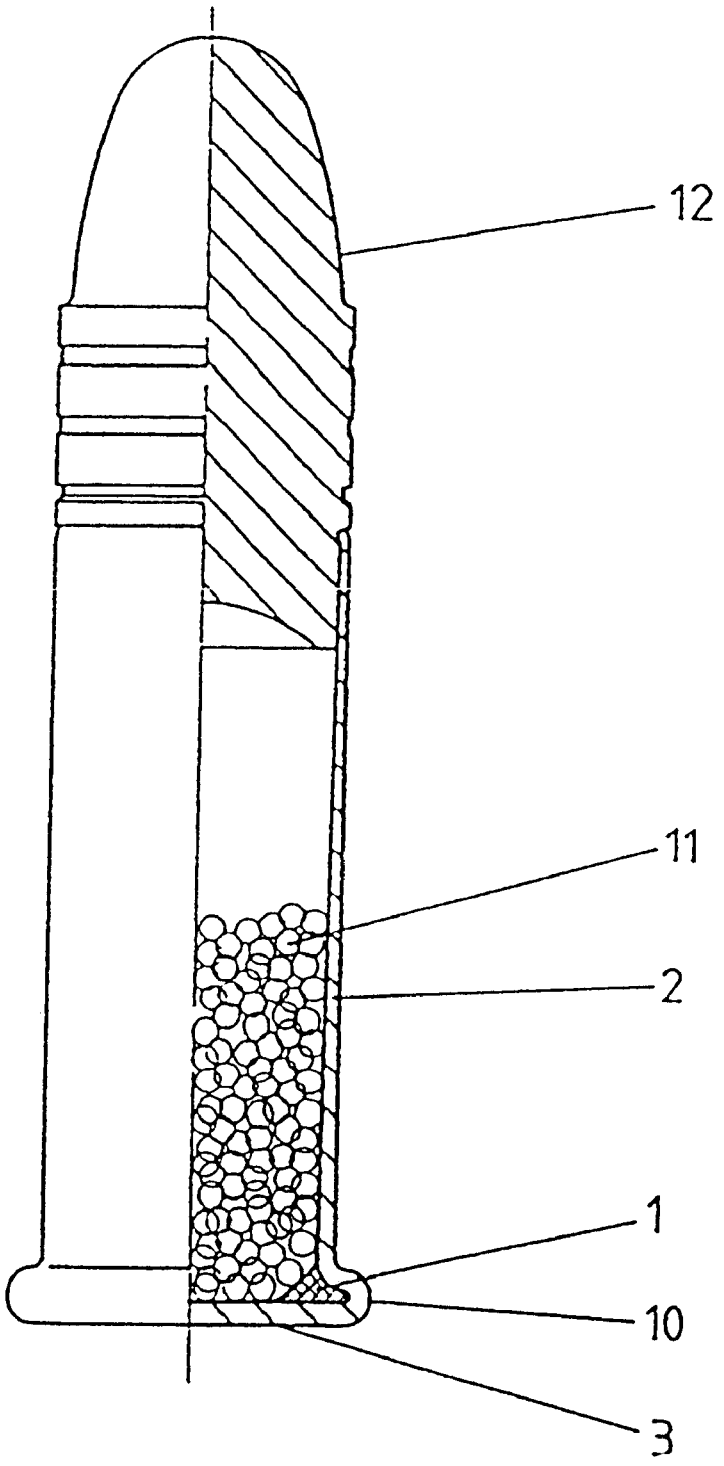
Fig. 1 PRIOR ART
FIG. 1 shows a rim-fire cartridge according to the prior art, in section.

FIG. 1 is described in the introduction to the description. With the exception of the cartridge case, this rim-fire cartridge is identical to the rim-fire cartridges in accordance with the invention that are described in the following.

Figure 2:
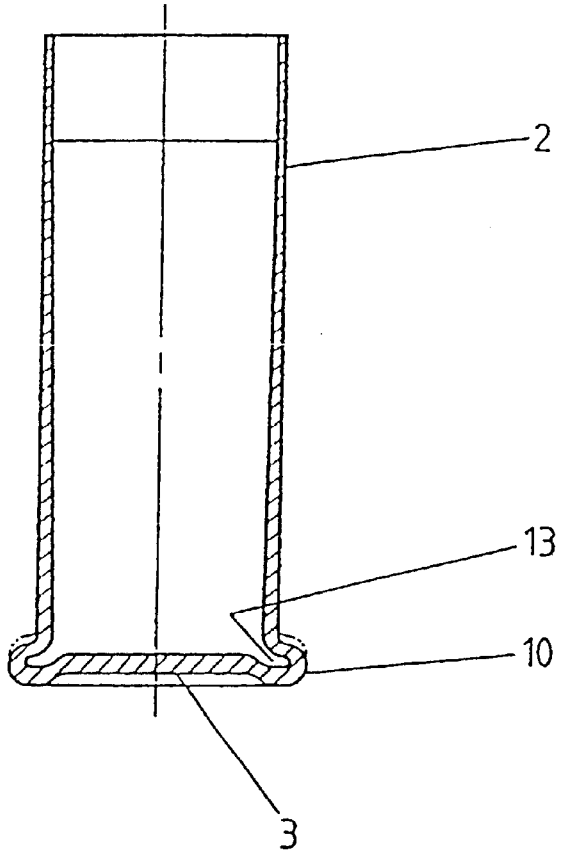
FIG. 2*a* shows a cartridge case of a rim-fire cartridge in accordance with the invention, in cross-section, with FIG. 2*b* showing the bulge in enlarged section.
Figure 2:
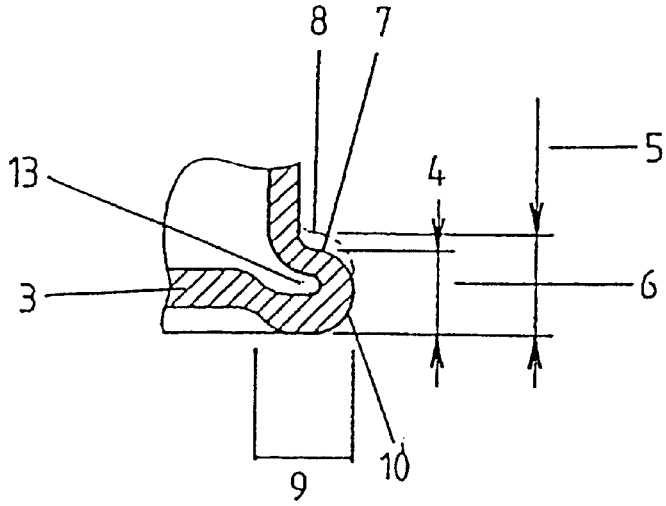

FIG. 2*a* shows a cartridge case 2 of a rim-fire cartridge in accordance with the invention, in section. Located at the base 3 of the cartridge case 2 is a circumferential bulge 10, into which, during filling, an ignition charge is placed, as a rule in liquid form (see FIG. 1 in this respect). The base 3 of the cartridge case is pressed axially inwards in the entire region with the exception of the actual bulge 10, so that a dome-shaped base 3 results.

FIG. 2*b* shows the region of the bulge 10 on an enlarged scale. It can clearly be seen that, as a result of the pressing in of the base 3, the opening 13 from the bulge 10 towards the inside of the cartridge case 2 is reduced; as a result of this a damming of the ignition charge which has been put in is achieved. FIG. 2*b* shows the bulge 10 after the re-pressing with a tool having flat pressing surfaces. Before the re-pressing, the bulge 10 or the edge 7 of the case had the contour 8 which is shown with a dashed line in the Figure. This re-pressing compresses the ignition charge, which is not shown. The reference numeral 9 indicates the radial width of the bulge 10. The reference numeral 5 indicates the necessary over-dimension of the height of the bulge 10 before the re-pressing. The reference numeral 4 indicates the height of the bulge 10 after the re-pressing. The reference numeral 6 indicates the tolerated inner edge height of the bulge 10 after the re-pressing.

Figure 3:
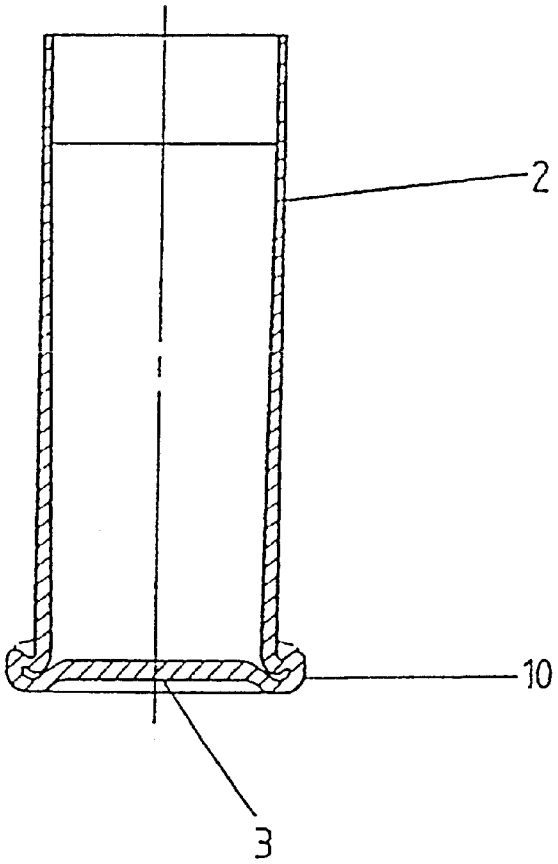
FIG. 3*a* shows an alternative cartridge case of a rim-fire cartridge in accordance with the invention, likewise with the bulge in enlarged section in FIG. 3*b*.
Figure 3:
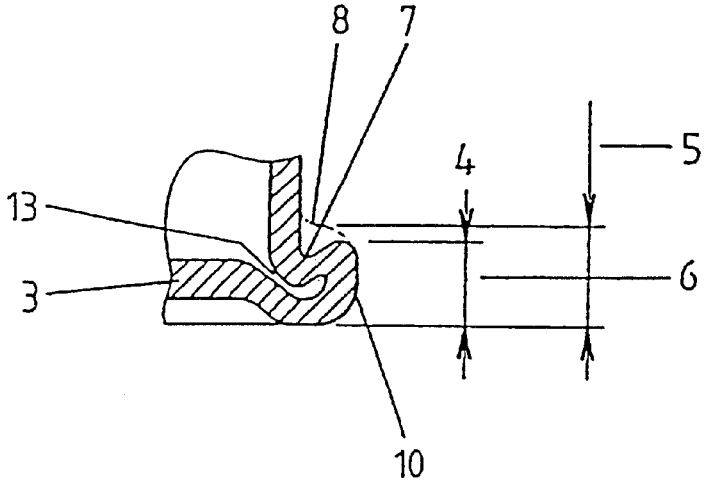

FIG. 3*a* shows an alternative embodiment of the cartridge case 2 or the bulge 10. Here too, the base 3 is pressed axially inwards, so that the opening 13 of the bulge 10 towards the inside of the cartridge case 2 is reduced (see FIG. 3*b*). FIG. 3*b* shows the bulge 10, again on an enlarged scale. The bulge

10 or the edge 7 of the case has here been re-pressed from the necessary over-dimension 5 (see dashed-line contour 8) to the required end height 4, so that a tolerated inner edge height 6 results. In this embodiment, however, the re-pressing took place with a sharp-edged tool, which has pressed in only the region of the bulge 10 or edge 7 of the case that adjoins the wall of the cartridge.

What is claimed is:

1. A rim-fire cartridge, comprising:

a cartridge case having a cylindrical wall and a closed base, the cartridge case having a circumferential bulge at the base extending radially outwardly from the cylindrical wall and having an opening into the interior of the cartridge case;

a projectile provided on and closing the cartridge case at an end opposite the base;

a propellant-charge powder provided inside the cartridge case; and an ignition charge for the propellant-charge powder provided in the circumferential bulge in the cartridge case;

wherein the base of the cartridge case has a projecting portion projecting axially inwardly towards the interior of the cartridge case to reduce a size of the opening of the bulge, the projecting portion including at least a portion of the base at a periphery of an internal diameter of the cylindrical wall of the cartridge case.

2. Rim-fire cartridge according to claim 1, wherein the base of the cartridge case is dome-shaped.

3. Rim-fire cartridge according to claim 1, wherein the ignition charge is a low-pollutant ignition charge.

4. A process for producing a rim-fire cartridge, comprising:

providing a cartridge case having a cylindrical wall and a closed base;

compressing the base in an axial direction to provide a circumferential bulge at the base extending radially outwardly from the cylindrical wall and having an opening into the interior of the cartridge case;

pressing a portion of the base of the cartridge case axially inwardly towards the interior of the cartridge case to reduce a size of the opening of the bulge, the projecting portion including at least a portion of the base at a periphery of an internal diameter of the cylindrical wall of the cartridge case;

providing an ignition charge in the bulge;

providing a propellant-charge powder in the cartridge case; and providing a projectile on an end of the cartridge case opposite the base.

5. Process according to claim 4, wherein the base is pressed to have a dome-shape.

6. Process according to claim 4, wherein the ignition charge is a low-pollutant ignition charge.

7. Process according to claim 4, further comprising re-pressing the bulge after the ignition charge has been introduced, to compress the ignition charge.

8. Process according to claim 7, wherein the bulge is re-pressed with a tool having flat pressing faces.

9. Process according to claim 7, wherein the bulge is re-pressed with a sharp-edged tool, with only a region of the bulge that adjoins the cylindrical wall cartridge case being pressed in.

* * * * *